US005348292A

United States Patent [19]

Norman, Sr.

[11] Patent Number: 5,348,292

[45] Date of Patent: Sep. 20, 1994

[54] TRAINING AID FOR IMPROVING THE THROW OF AN ATHLETE

[76] Inventor: George M. Norman, Sr., 556 W. Tennessee St., Tallahassee, Fla. 32301

[21] Appl. No.: 172,532

[22] Filed: Dec. 23, 1993

[51] Int. Cl.[5] ..... A63B 69/40

[52] U.S. Cl. ..... 273/26 C; 273/188 R; 273/189 R; 273/55 R

[58] Field of Search ..... 273/26 C, 55 R, 188 R, 273/189 R, 191 B, 29 A, 29 R; 128/5, 16, 4, 62; 602/23

[56] References Cited

U.S. PATENT DOCUMENTS

| | | | |
|---|---|---|---|
| 475,432 | 5/1892 | Blades | 273/189 R |
| 1,699,219 | 1/1929 | Bemish et al. | 273/189 R |
| 2,022,910 | 12/1935 | Homley | 273/189 R |
| 2,450,162 | 9/1948 | Promen | 273/188 R |
| 4,875,677 | 10/1989 | Tetreault | 273/26 C |
| 5,005,833 | 4/1991 | Groveman | 273/189 R |
| 5,248,146 | 9/1993 | Viets | 273/189 R |

*Primary Examiner*—Theatrice Brown
*Attorney, Agent, or Firm*—Carnes, Cona, & Dixon

[57] ABSTRACT

A training aid to help athletes throw a ball with more power and accuracy. A wrist strap and bicep strap are provided. The two straps are linked to one another and when so link restrict the movement of the user's elbow. When the elbow is so restricted, the user is forced to use the wrist when throwing a ball.

13 Claims, 4 Drawing Sheets

TRAINING AID FOR IMPROVING THE THROW OF AN ATHLETE

BACKGROUND OF THE INVENTION

When a person throws a ball, such as a baseball, football, or basketball, the person will typically use the strength of the arm, in a sweeping motion around the shoulder, to deliver the throw, keeping the wrist rigid. However, in order to deliver a more powerful throw as well as a more controlled and accurate throw, use of the wrist during ball delivery is also required. The wrist must be snapped during ball release. Therefore, in order to derive maximum throwing power and ball control, use of both arm strength and wrist strength is required.

A device is needed whereby the thrower is required to use the wrist to throw a ball. Repeated use of such a device will make use of the wrist a natural tendency during ball throwing. Use of the device will also strength the wrist actuation muscles.

The present invention provides a device whereby the user's elbow is held in a fixed position. When the elbow is so held, the use of the wrist is required in order to throw a ball. If the wrist is not used, the ball cannot be thrown. The device is a suitable training aid for baseball players, football passers, basketball players, soccer players, tennis players, and the like.

SUMMARY OF THE INVENTION

This invention provides for a training aid that, when properly placed on the throwing arm of an athlete, restricts the elbow angle of that arm and improves and corrects the use of the wrist when throwing the ball.

The training aid includes two straps. One strap is placed around the bicep and the second is placed around the wrist. Each strap is secured to its respective body part by an attachment means. A linking means is used to connect the two straps.

When the two straps are so connected, movement of the elbow is restricted. When movement of the elbow is restricted, the wearer is required to use the wrist in order to throw a ball. With practice, the athlete's wrist and the muscles which actuate the wrist become stronger, use of the wrist to throw a ball becomes natural, and a proper ball throwing technique is accomplished. A stronger and more controlled ball throw is the result.

Therefore, it is the object of the present invention to provide for a throwing aid to improve the throw of an athlete by strengthening the wrist and the muscles which actuate the wrist.

It is another object of the present invention to provide for a throwing aid that can accommodate any size wrist and bicep so that it can be utilized by male and female athletes, whether each is an adult or child.

It is another object of the present invention to provide for a throwing aid that is easy to use, economical to fabricate, and durable in operation.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
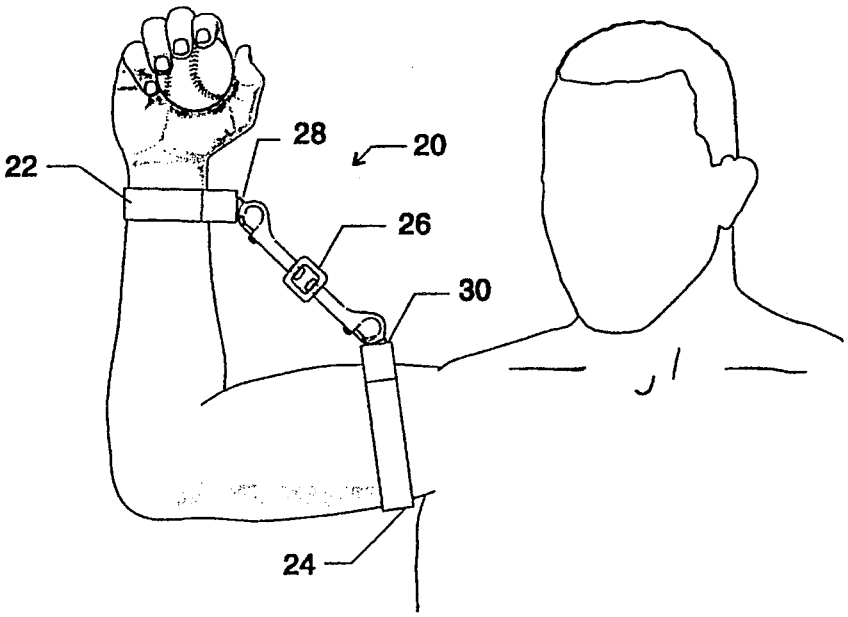
FIG. 1 is a perspective view of the first embodiment of the training aid of the present invention, shown in position on the throwing arm of a subject.
Figure 2:
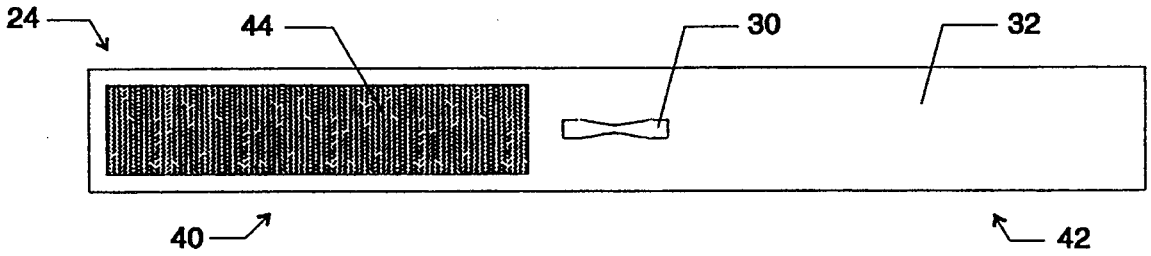
FIG. 2 is a top plan view of the first embodiment of the bicep strap of the training aid according to the present invention.
Figure 3:
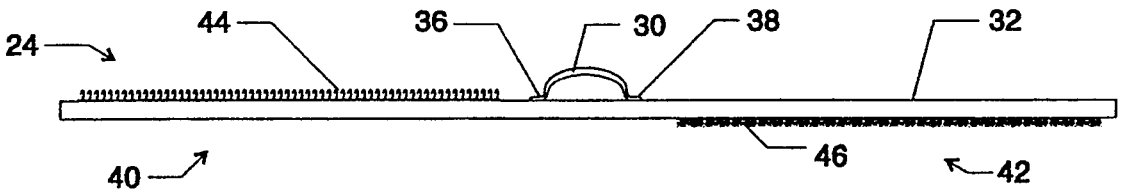
FIG. 3 is a side view of the bicep strap of FIG. 2.
Figure 4:
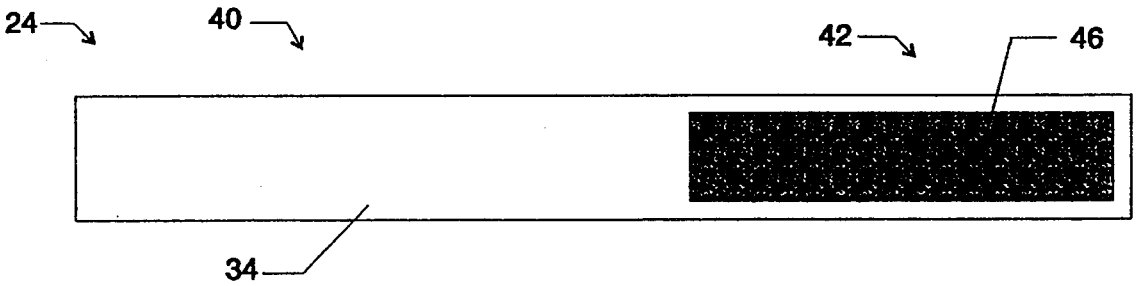
FIG. 4 is a bottom plan view of the bicep strap in FIG. 2.

FIG. 1 illustrates a subject wearing the first embodiment of the training aid 20 of the present invention. As seen, a wrist strap 22 is secured around the subject's wrist while a bicep strap 24 is secured around the subject's bicep. A link member 26 is fastened to a loop 28 located on the wrist strap and also to a loop 30 located on the bicep strap. The link member provides a restriction of movement for the elbow.

The bicep strap 24 is illustrated in further detail in FIGS. 2–5. As seen in these figures, the bicep strap 24 has an upper surface 32 and a bottom surface 34. Located in the middle of the upper surface is a loop 30. This loop 30 can be fabricated out of any durable or sturdy material such as canvas, metal, leather, or rope. If the loop is constructed of a rectangular piece of material, then the two middle edges of the loop are secured together by an attachment means such as sewing, gluing, etc. This provides added reinforcement to the loop as well as an easier means for the link member to attach to the strap.

The loop 30 is secured to the upper surface 32 of the bicep strap 24 of the loop at a first point 36 and a second point 38 by an attachment means. The attachment means can be accomplished by the use of adhesives, stitching, riveting, or any other attachment means.

The bicep strap 24 has a first side 40 and a second side 42. Secured on the upper surface of the first side is a fabric hook material 44. Secured on the lower surface of the second side is a fabric loop material 46. Together, the fabric hook material and fabric loop material are commonly known as Velcro. When the bicep strap is fit securely around an individual's upper arm during the utilization of the training aid, the bicep strap is firmly held in place by the Velcro attachment means.

Figure 5:
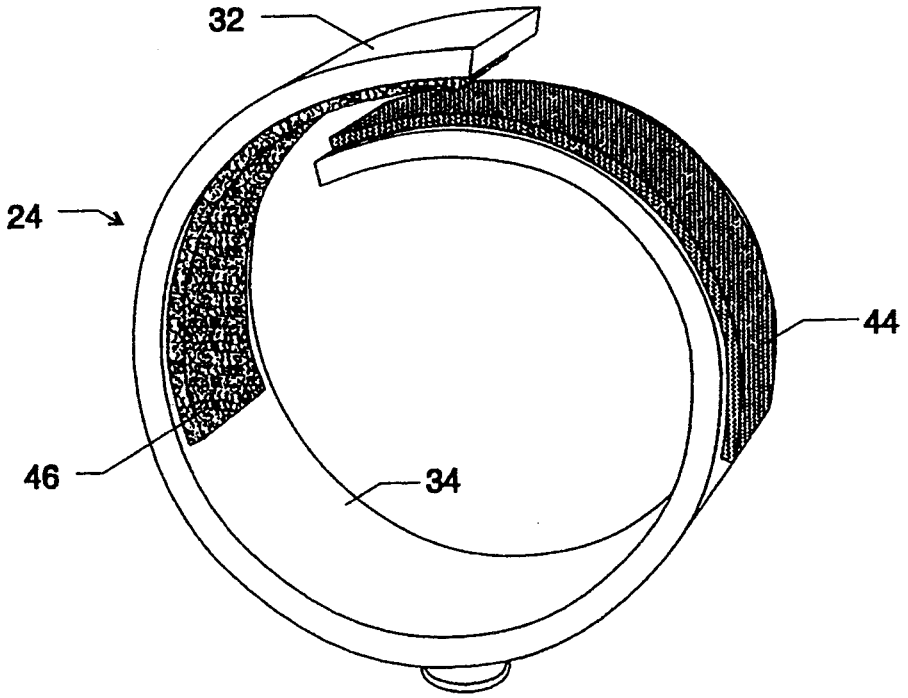
FIG. 5 is a enlarged scale perspective view of the first embodiment of the bicep strap of the training aid.

The cooperating fabric hook material 44 and fabric loop material 46 can be a self-adhesive type or it can be fastened to the bicep strap 24 by any conventional attachment means such as gluing or sewing. When the bicep strap is placed on the arm, the first side of the upper surface is disposed above the second side of the bottom surface, as illustrated in FIG. 5. An optional loop (not illustrated) can be utilized therein for a more secure attachment.

The wrist strap 22 is not separately illustrated in detail in that it is identical in design to the bicep strap 24, except that the wrist strap is typically of a shorter length.

Figure 6:
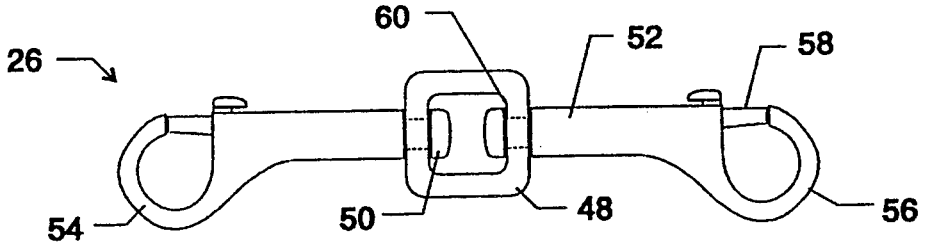
FIG. 6 is a side elevation view of a link member of the throwing aid of the present invention.

The link member 26 is attached to the loop 30 of the bicep strap 24 and a loop 28 located on the wrist strap 22. This link member, which restricts movement of the elbow, is shown in further detail in FIG. 6.

This link member 26 is comprised of two shafts or shanks 52. The first shank has a hook portion 54 at one end. The second shank also has a hook portion 56 at one end. At the other end of each shank is a swivel knob 50. The two swivel knobs are caged by a generally cylindrical barrel or body portion 48 having a hollow interior within.

The configuration of body portion 48 is not important and may take any shape or design so long as it permits each hook portion 54 and 56 to rotate independently of each other about the axis of each shank 52.

A spring-loaded manually operable slide finger 58 is provided for each hook portion 54 and 56. The hook portions are used to retain the link member to the wrist strap loop 28 and bicep strap loop 30. The slide finger provides the means of restraining or removing the hook portions from the two loops.

The swivel knobs 50 are restrained against movement out of the interior of the barrel 48 by an internal shoulder 60. These swivel knobs provide for each hook to rotate freely about the longitudinal axis of the link member.

Figure 7:
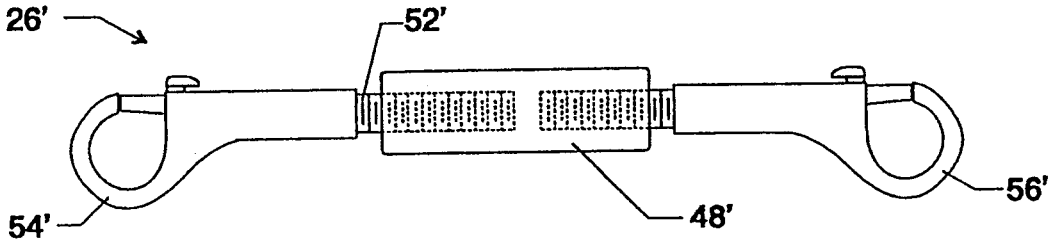
FIG. 7 is a side elevation view of a second embodiment for the link member of the throwing aid according to the present invention.

While a link member which has a fixed length will usually prove satisfactory, it may be desired to provide for a link member that has an adjustable length. FIG. 7 shows an alternative embodiment for the link member. This figure illustrates a link member 26' which allows for its length to be adjusted. The link member is generally arranged as a turnbuckle and includes an internally threaded barrel or body portion 48'. Each shaft 52' is also threaded and is received and screwed into the body portion in order to obtain the desired length for the link member. Attached to each shank is a respective hook portion 54' and 56'. These hook portions can be readily attached to or detached from its respectively loops located on the bicep and wrist straps.

The link members of the first and second embodiments 26 and 26' are fabricated from a rigid and durable material such as plastic, rubber or metal.

Figure 8:
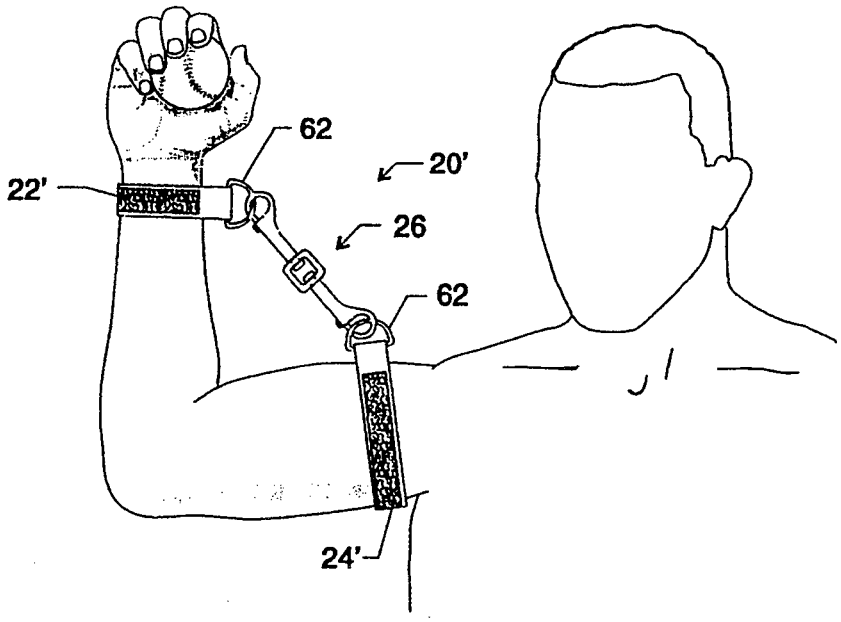
FIG. 8 is a perspective view of the second embodiment of the training aid according to the present invention, shown in position on the throwing arm of a subject.

FIGS. 8–11 illustrates a second embodiment of the training aid of the present invention. As seen in FIG. 8, a subject is wearing the second embodiment of the throwing aid 20'. In this figure a wrist strap 22' is secured around the wrist and a bicep strap 24' is secured around the bicep. Restricting the movement of the elbow is accomplished by a link member 26. The link member is fastened to two retainer rings 62, one located on wrist strap and the other located on the bicep strap.

Figure 9:
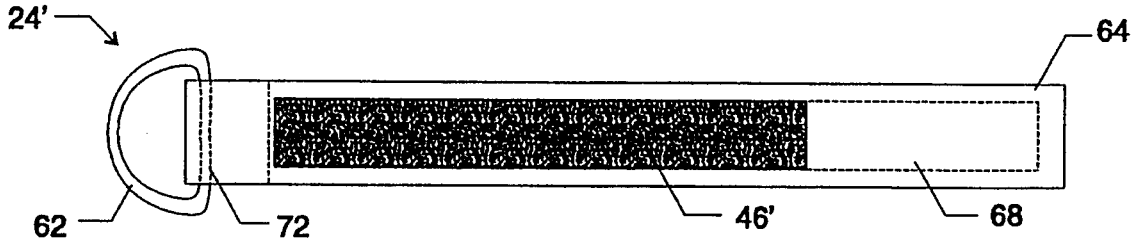
FIG. 9 is a top plan view of the second embodiment of the bicep strap of the training aid of the present invention.
Figure 10:
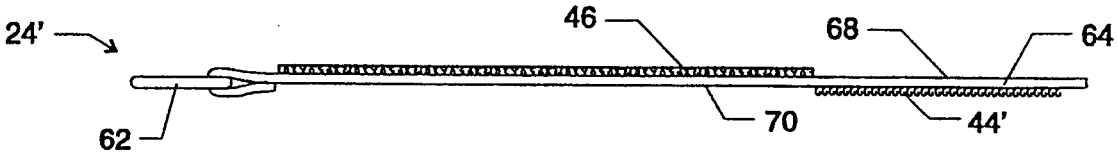
FIG. 10 is a side view of the bicep strap of FIG. 9.
Figure 11:
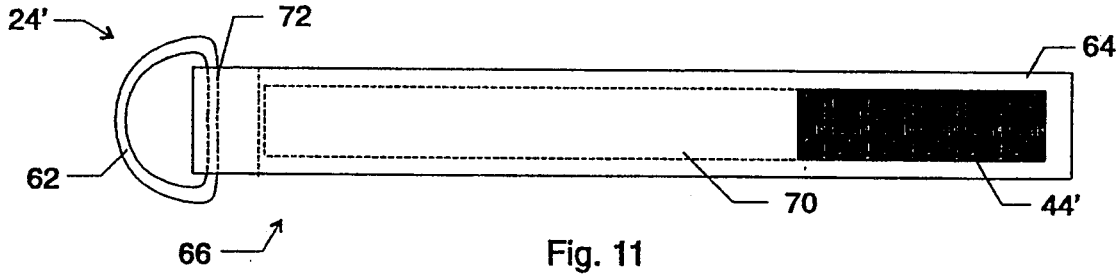
FIG. 11 is a bottom plan view of the bicep strap of FIG. 9.

FIGS. 9–11 illustrate the various views of the second embodiment of the bicep strap 24'. The bicep strap has a free end portion 64 and a retainer end portion 66. The strap also have an upper surface 68 and a lower surface 70. Located at the retainer end portion is a retainer ring A part of the retainer end portion loops around the retainer ring providing for a secure hold at attachment point 72 by an attachment means in order to secure the retainer ring to the strap. The attachment means can be accomplish by any conventional means such as the use of an adhesive, sewing, or riveting.

The bicep strap 24' is attached to the upper arm of the thrower by passing the free end portion 64 through the retaining ring 62. The free end portion is then pulled through far enough to produce a snug fit. Once the desired fit is obtained, the free end portion is affixed to the body of the strap by an attachment means. This maintains a snug and secure fit while the throwing device is in use.

Velcro is used as the attachment means. The fabric hook material 44' is attached to the lower surface of the strap at the free end portion 64 and the cooperating fabric loop material 46' is attached to the upper surface of the strap at the retaining end portion 66.

The wrist strap is not separately illustrated in detail in that it is identical in design to the bicep strap except that the wrist strap is typically shorter.

Figure 12A:
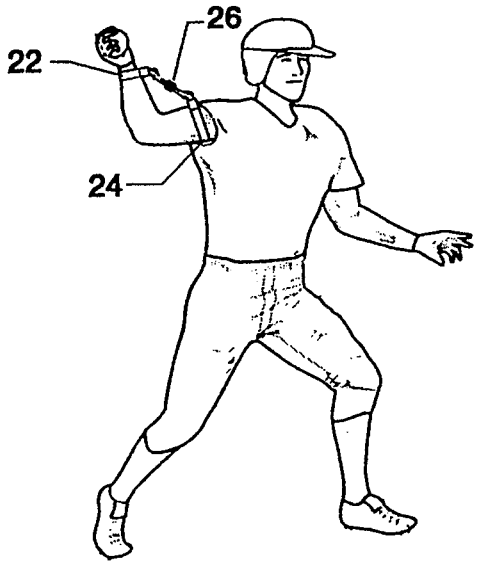
FIG. 12 is a graphic illustration of an athlete using the training aid of the present invention, throwing a ball.
Figure 12B:
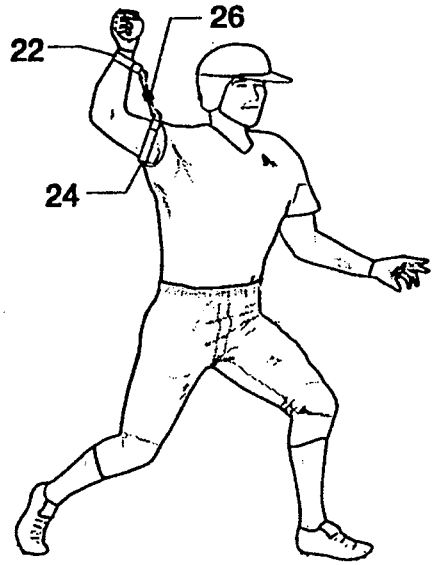
Figure 12C:
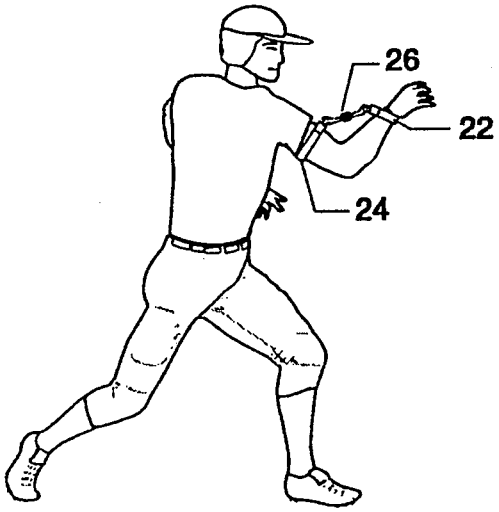

FIGS. **12*a*–12*c* show the throwing device of the present invention, in either the first or second embodiment, being utilized. In FIG. 12*a*, the subject secures the wrist strap around the wrist and the bicep strap around the upper arm. A link member 26**, is attached to the wrist strap and bicep strap and provides the necessary movement restriction to the elbow.

In throwing a ball, the wrist is extended backwards pulling against the bicep strap in a cocked position ready to snap forward with the ball. In FIG. **12*b*** the thrower's weight is shifted forward and the wrist is moved forward with the lower arm remaining in a nearly vertical position. The wrist is still in a cocked position.

FIG. **12*c*** shows that the thrower has moved all the way forward with most of his weight on the foot opposite to the throwing arm (i.e. left foot for a right handed thrower) and has just released the ball with the maximum possible speed. In so doing, the wrist has snapped forward from its cocked position. Throughout this entire motion the wrist and the bicep of the throwing arm remain substantially the same distance from each other forcing the thrower to use the power of his wrist to throw the ball. With constant use of the throwing device, an individual or subject will improve and correct their wrist action.

The straps of the first and second embodiment illustrated in FIGS. 1–5 and 8–12 can be fabricated from leather, plastic, fabric, or any other material which is sufficiently durable, flexible, and sturdy in order to fit around the thrower's arm and wrist and to resist the forces produced by throwing a ball.

While the invention has been particularly shown and described with reference to an embodiment thereof, it will be understood by those skilled in the art, that various changes in form and detail may be made without departing from the spirit and scope of the invention.

I claim:

1. A training aid for improving the throw of an individual comprising:

an adjustable bicep strap to fit securely around the bicep of an arm;

said adjustable bicep strap includes an upper surface and a bottom surface;

said adjustable bicep strap includes a first end portion, a middle portion and a second end portion;

said first end portion and said second end portion being equal in length;

said middle portion being about $\frac{1}{3}$ the length or less of said first end portion;

a first loop secured to said upper surface at said middle portion;

a first means for attaching and detaching said first end portion in adjusted overlapped position with respect to said second end portion;

said first means comprises a first hook and a first loop material;

said first hook material is attached at said first end portion on said upper surface and said first loop material is attached at said second end portion on said bottom surface;

an adjustable wrist strap to fit securely around the wrist of said arm;

said adjustable wrist strap includes a top surface and an underside surface;

said adjustable wrist strap includes a first end section, a middle section, and a second end section;

said first end section and said second end section being equal in length;

said middle section being about ⅓ the length of said first end section;

a second loop secured to said top surface at said middle section;

a second means for attaching and detaching said first end section in adjusted overlapped position with respect to said second end section;

said second means comprises a second hook and a second loop material;

said second hook material is attached to said top surface at said first end section and said second loop material is attached to said underside surface at said second end section; and a rigid link member having opposite hook end portions respectively connectable to said first loop and said second loop in order to restrain movement of an elbow of said arm when said adjustable bicep strap and said adjustable wrist strap are utilized.

2. The training aid as in claim 1 wherein said hook end portions of said rigid link member are provided with spring-loaded hook closing slide elements.

3. The training aid as in claim 1 wherein said rigid link member includes a barrel, said barrel has a first end and a second end, said hook end portions are respectively affixed to said first end and said second end.

4. The training aid as in claim 3 wherein at least one of said hook end portions comprises a screw-threaded shank and said barrel is provided with an internally threaded opening in which said shank is threadedly engaged.

5. The training aid as in claim 1 wherein said rigid link member is constructed of metal.

6. The training aid as in claim 1 wherein said adjustable bicep strap and said adjustable wrist strap are constructed from leather.

7. The training aid as in claim 1 wherein said adjustable bicep strap and said adjustable wrist strap are constructed from canvas.

8. A training aid for improving the throw of an individual comprising:

an adjustable bicep strap to fit securely around the bicep of an arm;

said adjustable bicep strap includes an upper surface and a lower surface;

said adjustable bicep strap includes a first free end portion and a first retainer end portion;

a first retainer ring;

said first retainer ring is secured to said first retainer end portion by a first securing means;

a first means for attaching and detaching said first free end in adjusted overlapped position with respect to said retainer end portion;

said first means comprises a first hook and a first loop material;

said first hook material is attached at said first free end portion on said lower surface and said loop material is attached at said first retainer end portion on said upper surface;

an adjustable wrist strap to fit securely around the wrist of said arm;

said adjustable wrist strap includes a top surface and a bottom surface;

said adjustable wrist strap includes a second free end portion and a second retainer end portion;

a second retainer ring;

said second retainer ring is attached to said second retainer end portion by a second securing means;

a second means for attaching and detaching said second free end portion and said second retainer end portion;

said second means comprises of a second hook and a second loop material;

said second hook material is attached to said second free end portion on said bottom surface and said second loop material is attached to said second retainer end portion on said top surface;

a rigid link member having opposite hook end portions respectively connectable to said first retainer ring and said second retainer ring in order to restrain movement of an elbow of said arm when said adjustable bicep strap and said adjustable wrist strap are utilized.

9. The training aid as in claim 8 wherein said hook end portions of said rigid link member are provided with spring loaded hook closing slide elements.

10. The training aid as in claim 8 wherein said rigid link member includes a barrel, said barrel has a first end and a second end, said hook end portions are respectively affixed to said first end and said second end.

11. The training aid as in claim 10 wherein at least one of said hook end portions comprises a screw-threaded shank and said barrel is provided with an internally threaded opening in which said shank is threadedly engaged.

12. The training aid as in claim 8 wherein said first securing means and said second securing means is accomplished by sewing.

13. The training aid as in claim 9 wherein said first securing means and said second securing means is accomplished by the use of an adhesive.

* * * * *